United States Patent [19]

Snyder

[11] Patent Number: 4,987,909

[45] Date of Patent: Jan. 29, 1991

[54] METHOD OF SELECTIVE HAIR COLORING AND COLORING COMB FOR PRACTICING METHOD

[76] Inventor: Susan L. Snyder, 5917 Ervin St., Springfield, Va. 22150

[21] Appl. No.: 857,347

[22] Filed: Apr. 30, 1986

Related U.S. Application Data

[63] Continuation of Ser. No. 309,767, Oct. 8, 1981, abandoned, which is a continuation of Ser. No. 856,539, Dec. 1, 1977, abandoned.

[51] Int. Cl.[5] ..... A45D 7/00

[52] U.S. Cl. ..... 132/202; 132/205

[58] Field of Search ..... 132/7, 202, 203, 204, 132/205, 206, 207

[56] References Cited

U.S. PATENT DOCUMENTS

| | | | |
|---|---|---|---|
| 2,245,111 | 6/1941 | Mauriell | 132/7 |
| 2,265,656 | 12/1941 | Snyder | 132/7 |
| 3,349,781 | 10/1967 | Poole et al. | 132/7 |

*Primary Examiner*—V. Millin

*Attorney, Agent, or Firm*—Browdy and Neimark

[57] ABSTRACT

A method of coloring selected hair shafts with a thixotropic hair treating material, while leaving adjacent hair shafts untreated, in which a thixotropic hair treating material is laid down onto a plurality of generally parallel spaced and non-overlapping areas running along the lay of the hair; and a method of touching up hair which has been so treated, after the roots have grown out.

13 Claims, 3 Drawing Sheets

FIG.4
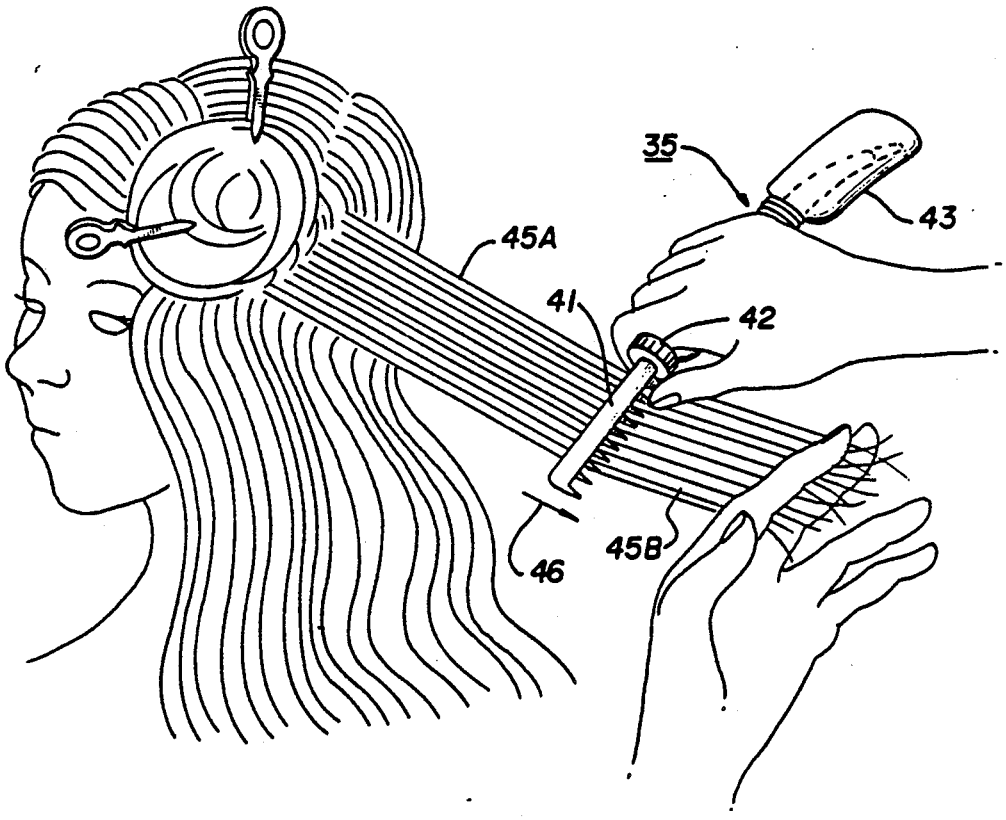
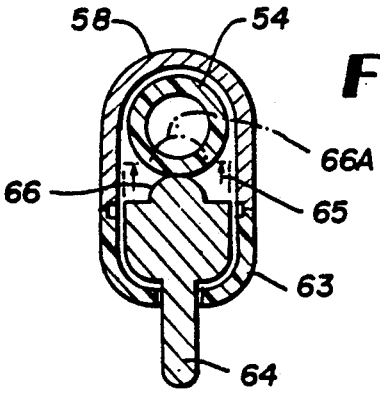
FIG.6
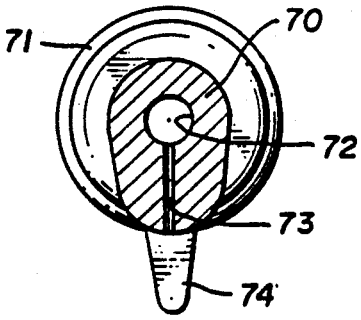
FIG.7
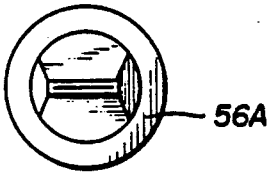
FIG.9

FIG. 5
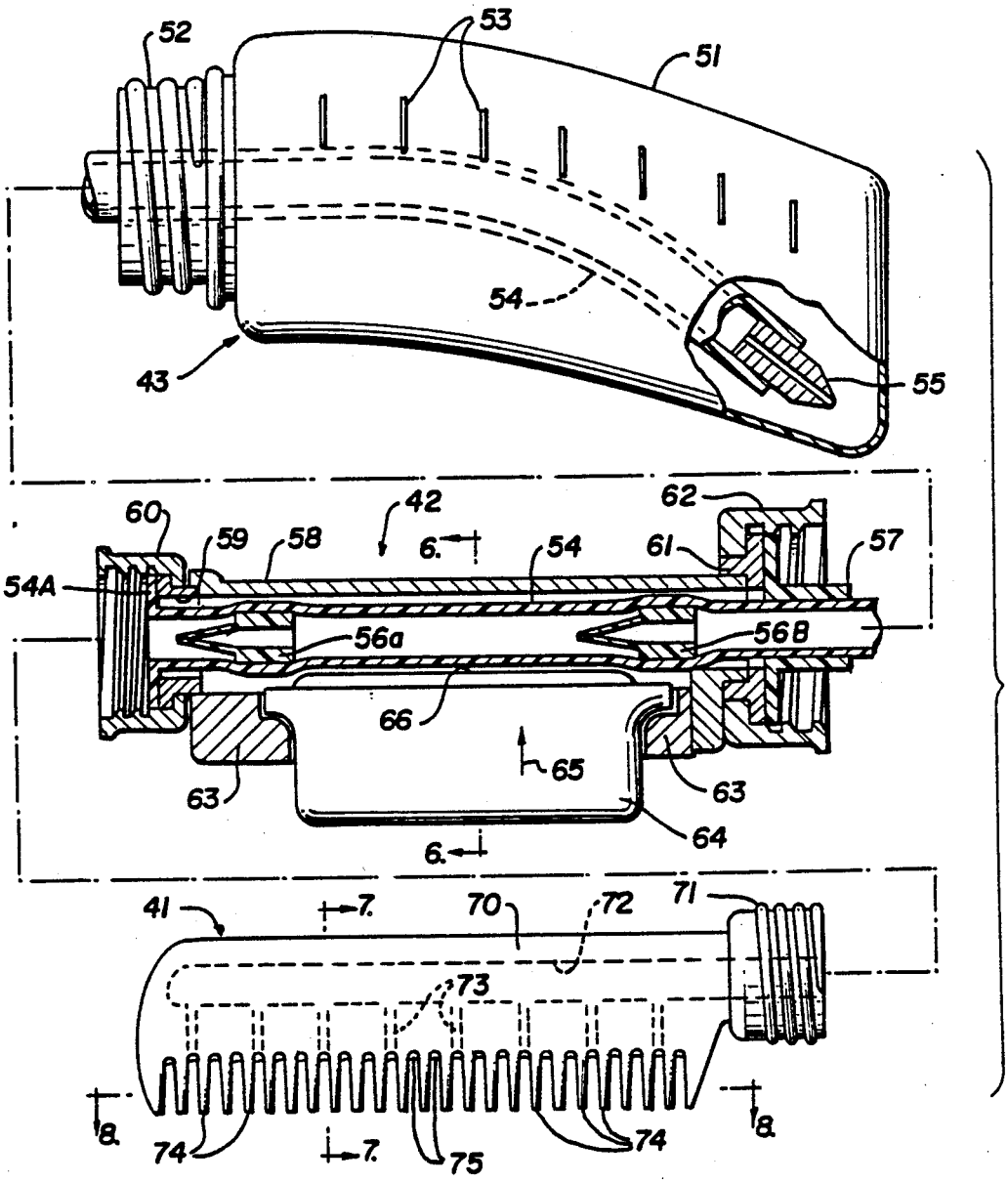
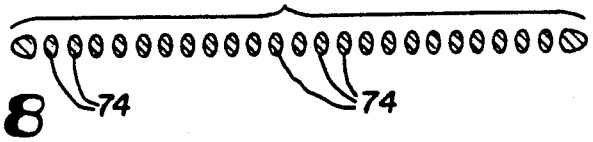
FIG. 8

METHOD OF SELECTIVE HAIR COLORING AND COLORING COMB FOR PRACTICING METHOD

This application is a continuation of application Ser. No. 309,767, filed Oct. 8, 1981, which is a continuation of application Ser. No. 856,539, filed Dec. 1, 1977 both now abandoned.

GLOSSARY

For the purpose of this disclosure, but consistant with the useage in the art, the following terms are defined:

Coloring: To lighten, as by bleach, or to darken, as by dye.

Strand: A bundle of individual hair shafts, all of which have roots in the same closed area of the scalp, with substantially every hair in that closed area included in the strand.

Laminar Sheaf: A special case of a strand in which the roots of the individual hair shafts are all located in a small and generally rectangular area of the scalp (1 to 5 centimeters wide by 6 to 12 centimeters long would be typical but not limiting) and in which all the hair of the laminar sheaf is combed out parallel and held under tension, as shown in FIGS. 3 and 4, so that the laminar sheaf along its length approximately retains its original width at the scalp but decreases in thickness from its original thickness at the scalp. The laminar sheaf is dense and not open; it substantially obstructs vision therethrough.

Parting: As a verb, the act of dividing the hair into portions constituting strands as defined herein. As a noun, often used in the art to describe a strand so formed. A parting can be a laminar sheaf, or it can be a coiled up bun, etc.

Face: The approximately planar exposed portions of the laminar sheaf. There is an inner face, which consists of those hair shafts which are normally closer to the scalp when the hair is in repose, and a corresponding outer face. Generally, when the hair stylist holds a sheaf from the lower part of the hair, the outer face is the nearer and visable one. But when holding up a sheaf of hear near the crown, the inner face may be the nearer and visable one. Either face may be the site of selective coloring.

Hair Treating Material: material which will color hair. It may be a solution, a visious liquid, a thixotropic liquid or a gel.

BACKGROUND OF INVENTION and SYNOPSIS

During our bicentennial year, about 43 million visits were made by clients to beauty shops in the United States. A substantial number of these visits involved changing the color of the client's hair.

Thus, the coloring of hair is an important volume business, and it is estimated that the hair dye industry grosses 280 million dollars a year.

While it is relatively easy to change the color of the hair, as a whole, by dyeing to make it darker, or by bleaching to lighten it, the result of only dyeing or only bleaching may be disappointing. The hair so treated tends to have an uninteresting uniform color. It is customary to follow dyeing or bleaching operation with another step, in which selected strands of hair are further treated so that their color will change and so that these selected strands will stand out against the background provided by the remainder of the hair. Similarly, selected strands of hair of a person's natural hair can be treated.

Treatment of selected strands of hair to change the color is called streaking if the selected strands are lightened, or reverse streaking if they are darkened. Other terms such as frosting and tipping are related and will be discussed below. Streaking can produce an appearance similar to that of highlights glistening on the hair, and is much desired. Reverse streaking can give an appearance of texture to dull hair. It can also be used when the client wishes to return to her or his own natural shade. In this case, as the roots grow out, the previously bleached hair can be reverse streaked to make less apparent the difference between the different portions of hair.

The task of coloring selected strands of hair is difficult for the hair stylist, since many strands of hair all over the head must be individually treated with appropriate treating material, while guarding the general mass of hair from contact with the treating material, and it is arduous for the client because of the length of time involved.

Indeed, in the frosting cap method, the procedure is actually painful to the client. In this method the hair is first combed, then covered with a thin film of plastic and finally covered with a heavy rubber cap, which is provided with a large number of small holes. The hair stylist uses a smooth crochet hook to punch through the plastic film at each hole in the rubber cap, snares the hair which lies underneath the hole and fishes it out with the hook. Considerable force must be used to fish out the selected strands of hair because of the adjacency of other strands, and the confinement of the plastic film and rubber cap. After the selected strands are pulled out and exposed, outside of the rubber cap, they are treated with treating material, which is kept from reacting the scalp and the remaining hair by the tight fit of the rubber cap and plastic film.

The frosting cap method is popular and has certain advantages. There is no contact of the scalp with the chemicals used, and the treated hair is well segregated from the hair which is not to be treated. However, besides the painful aspects mentioned above, there is much breakage of hair, the hair stylist has limited control of which particular strands of hair are pulled out, and the rubber cap must stay in place for the wearisome time of up to an hour.

Another method, the "Dixie Cup" method, utilizes cups. Selected strands of hair are pulled through a small hole in the bottom of the cup into the interior thereof, the selected strands are then treated and packed into the cup. The method permits greater contol by the hair stylist of the choice of which particular strands of hair are to be treated than does the frosting cap method. However the size of the cups dictates that the different treated strands must be widely spaced, which is a disadvantage. This method is time consuming since each cup must be individually handled. It is difficult to manipulate short hair into the cup. The Dixie Cup method has not gained great popularity.

In the foil method of coloring hair, the hair stylist isolates a strand of hair from the remaining hair, and lays it over a piece of foil which is butted up against the scalp, adjacent the roots of the isolated strand. The isolated strand is then treated with treating material and the foil is folded around it to act as a barrier against migration of the treating material. It is difficult for the hair stylist using this method to follow the progress of the treatment since the hair being treated is hidden. When streaking, some of the hair is sometimes overbleached.

Another method is the weaving comb method. Considering the manipulations required of the hair stylist, this method is closest in approach to, although distinct from, the instant invention.

The weaving comb method is well described in American Hairdresser Salon Owner, Volume 100, Number 3, March 1977, at page 76. Note particularly illustration 10. Briefly, the method uses a weaving comb, which has gullets of two depths between its teeth. When the comb is used, it acts like the headles of a loom to separate the hair being combed into an upper and a lower flight, with a shed between, and with the upper flight flowing through the comb adjacent the spine of the comb and the lower flight flowing through the comb closer to the tips of the teeth. Treating material is placed on the spine of the comb, adjacent the teeth. When the hair is then combed with the weaving comb, some of the treating material transfers to the hair shafts of the upper flight while the hair shafts of the lower flight are not touched by the treating material because of the separation provided by the shed. This method has the advantage of applying the treating material to the hair being combed during a single stroke of the weaving comb. However, considerable time is taken to prepare a parting of hair for the weaving comb, and the comb must be reloaded with treating material for each stroke.

The instant invention differs from the other methods of selectively applying treating material in that much less handling of the hair is required, as will be seen from the following synopsis:

The hair is initially divided into partings and each parting is sequentially treated. If desired, partings can be isolated from other partings by barrier material. There may be, typically, about twenty partings. Each parting is combed out into a laminar sheaf, as defined above. A special coloring comb is run through the laminer sheaf only once, to deposit the treating material in a controlled manner on spaced selected hair shafts of the outer face of said laminer sheaf, while the intercalated hair shafts of the outer face of said sheaf are not treated. The special coloring comb is so constructed as to clearly delineate the treated areas from the intercalated untreated areas.

The just described treatment of one parting proceeds, seratim, in a systematic manner, as determined by the desired style, usually from the nape upward. If desired, each parting, when treated, may be separated with barrier material so that treating material does not transfer between adjacent partings.

Because the handling of each parting involves only three steps, namely conventional combing, one stroke with the special dispensing comb, and optional barrier application, each parting can be handled in less than a minute, and the entire head of hair can be treated in about twenty minutes. This compares very favorably with the amount of time required of the hair stylist by other methods.

BRIEF DESCRIPTION OF FIGURES OF THE DRAWING

FIG. 4 is a view from the side opposite that seen in FIG. 3, showing how a parting on the side of the head above the ear is manipulated.

FIG. 5 is a partly exploded view of one style of coloring comb adapted to be used in the invention, showing the container for the treating solution, the handle-pump, and the comb-head.

FIG. 6 is a cross section of the handle pump portion of the coloring comb of FIG. 5, taken on the section 6—6.

FIG. 7 is a cross section of the comb-head portion of the coloring comb of FIG. 5, taken on the section 7—7.

FIG. 8 is a cross section of the comb teeth of FIG. 5, taken on the section 8—8.

FIG. 9 is an end view of one of the duck-bill valves used in the pump.

DETAILED DESCRIPTION

As a preliminary step it is necessary to determine, by discussion between the client and the hair stylist, what style of hair is to be achieved, for the coloring must be applied in a manner dependent on the style. The hair will be brushed and draped in different directions for different styles, and the color must be applied so as to show properly when the hair is brushed in the particular direction dictated by the chosen style.

The desired hair style determines the partings which will be made in order to color the hair. The partings can be visualized by reference to FIG. 1, which illustrates the areas of the skull corresponding to one possible scheme of partings. A series of fifteen generally parallel areas run from the brow, at 11, past the crown at 12 and the occiput at 13 to the nape at 14. The area above the ear is divided into areas 15 to 17. The areas shown in FIG. 1 can be described as arranged generally horizontally. Another hair style might require areas which are arranged generally vertically, with the areas proceeding around the skull from one side around the back to the other side.

Figure 1:
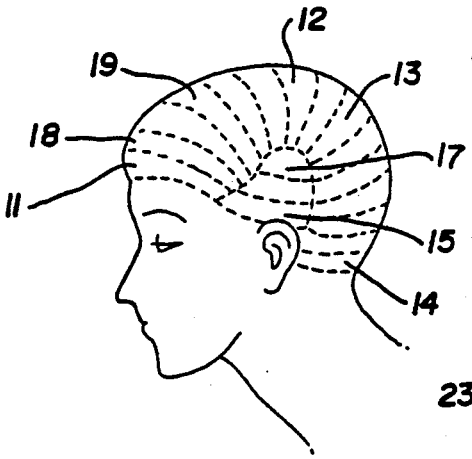
FIG. 1 shows the areas of the scalp, for a particular hair style, which are the origins of the hair partings for that style.
Figure 2:
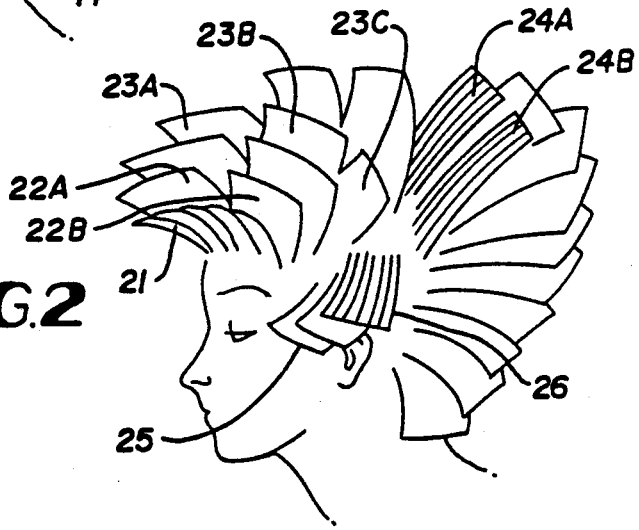
FIG. 2 shows, in an "exploded" expository manner, some of the possible hair partings which correspond to the areas shown in FIG. 1.

FIG. 2 illustrates how hair partings relate to the areas of FIG. 1. Some of these hair partings, namely, 21, 24A, 24B and 26 are depicted in a striped manner to indicate the individual hair shafts of a parting, while the other hair partings are depicted only by their outlines, in order to avoid confusion. It will be seen that the area 11 corresponds to the single parting 21, the area 18 corresponds to two partings 22A and 22B and the area 19 corresponds to the three partings 23A, 23B and 23C. The partings of FIG. 2 are not intended to accurately reflect actual partings, but are intended to be expository. The reason why an area such as 19 corresponds to three partings rather than to one parting will be apparent by considering how the partings are manipulated. This is illustrated in FIGS. 3 and 4.

Figure 3:
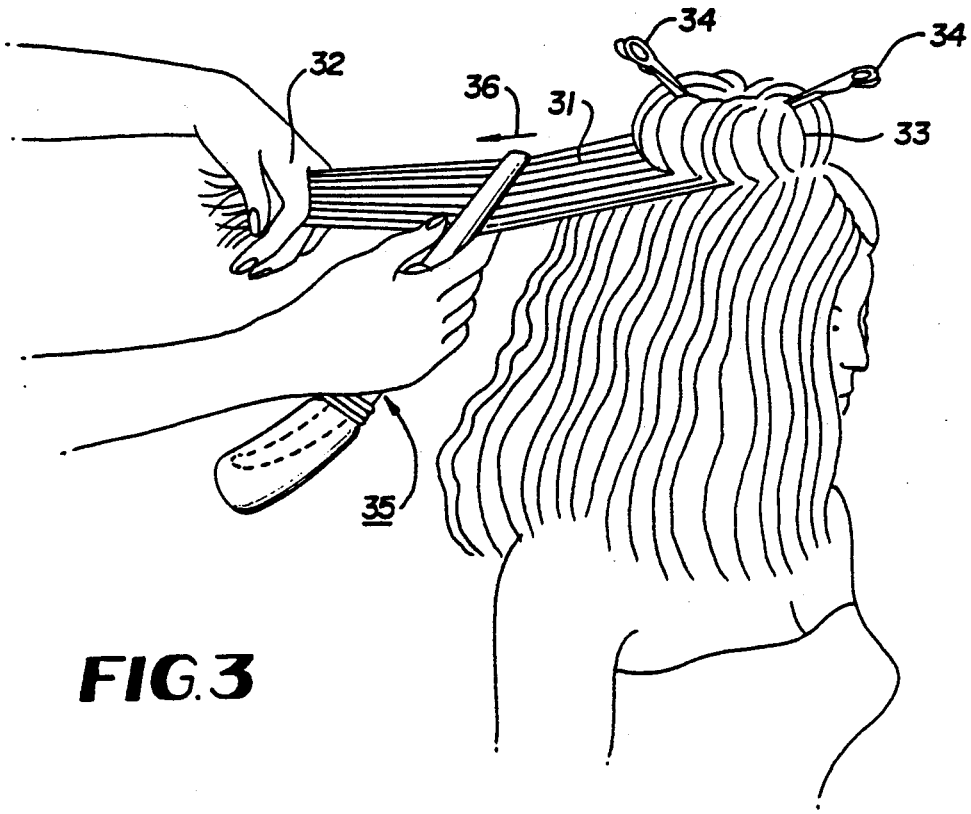
FIG. 3, is a side view, showing how a particular parting of hair, at the back of the head, near the occiput, is manipulated.

FIG. 3 illustrates how a parting, which corresponds approximately to parting 24A of FIG. 2, is drawn out into a laminar sheaf 31 running between the scalp and the hair stylist's left hand and fingers 32. In order to obtain access to the hair of laminar sheaf 31, the normally overlying hair has been piled up atop the head into a bun 33 and the bun is held in place temporarily by clips 34. Just before the moment depicted in FIG. 3, the hair stylist had selected the parting and combed it out with a conventional comb so that the hair shafts became parallel, to form the laminar sheaf 31. The thickness of this sheaf at the hair stylists hands and fingers is very slight, while the thickness increases toward the scalp to a value which would typically be between 1 and 5 centimeters. The width of the laminar sheaf is limited by the length of the hair stylists fingers, unless the hair stylist uses a clamping tool which has a clamping face longer than the fingers, and is limited by the length of the coloring comb head, which will be described below. A typical width would be between 6 and 12 centimeters.

As illustrated in FIG. 3, the hair stylist has the previously combed laminar sheaf 31 in a state of tension and is drawing the coloring comb 35 in the direction 36 through the hair for a single stroke. During this stroke the coloring comb 35 lays down on the top face of laminar sheaf 31 a series of spaced deposits of hair treating material, running along the length and lay of the hair, said deposits being separated by spaces whereat no treating material is deposited.

The hair treating material deposited on the upper face of laminar sheaf 31 is compounded so at to lighten or darken the hair, and is also compounded so that it sinks locally into the hair and acts thereon without migrating away suficiently to close up or intrude on the desired spaces between the deposits. A prefered way to accomplish this result is to incorporate into the hair treating material a thixotropic agent, which will permit the hair treating material to act for a few seconds as a liquid, after it has been subjected to high sheering forces while being deposited, and then, when the sheering forces are removed, permits the hair treating material, which by that time has penetrated locally into the hair, to solidify and stay put.

If the hair treating material is put down so as to color tiny isolated strands of hair uniformly all over the head, the process is called frosting. If the hair treating material is put down so as to color wide strands of hair, the process is called streaking or reverse streaking. If the hair treating material is put down so that only a portion of the strands, terminating at the tip, are colored, the strands being either tiny or wide, the process is called tipping.

The widths of the treated areas of hair and the spacing between these areas is determined by the construction of the coloring comb, which will be explained below. On the other hand, the portions of the laminar sheaf, with respect to the direction along the length of the hair shaft, which are treated, are determined by the way the hair stylist manipulates the coloring comb.

If the coloring comb is moved in the direction 36 all the way from the scalp to the tips of the hair, the full length of some of the hair shafts will be treated. If the coloring comb is inserted into the laminar sheaf at point spaced from the scalp and then drawn all the way to the tips of the hair shafts, a different effect, called tipping, is achieved. The coloring comb can be inserted into the laminar sheaf as in tipping, and drawn only partway to the tips of the hair to achieve a yet different effect.

FIG. 4 depicts a view of the hair stylist manipulating a laminar sheaf 45A, 45B, which corresponds roughly with the area 17 above the ear in FIG. 1. The coloring comb 35 consists of a reservoir section 43, in which the hair treating material is stored, a handle-pump section 42, by which the coloring comb is grasped, and which, when squeezed, pumps hair treating material to the comb-head 41. While the laminar sheaf is held under tension, the comb is drawn through the hair in the direction 46, while pressing downward on the sheaf. It will be recognized that hair is straightened out and arranged in parallel laminar arrangement more perfectly with successive combings. Thus, the portion of laminar sheaf 45A is depicted as being in better array than the portion 45B. This is an important advantage of the coloring comb - it is self guiding and corrects small misarrays of the laminer sheaf. Since the coloring comb is self guiding, it is possible for the hair stylist to work rapidly. The downward pressure of comb-head 41 produces a dihedral angle between portions 45A and 45B of the laminar sheaf. This downward pressure ensures that the particular hair shafts which are to be treated are pressed to the bottoms of the gullets between the teeth of comb-head 41, at which bottoms the hair treating material is dispensed so as to deposit on the particular strands being treated.

The coloring comb 35 is shown in FIG. 5 in a partly disassembled and exploded and partly cross sectioned view. The reservoir section 43 includes a polymeric bottle 51 having an external screw thread 52 at the opening and markings 53 to indicate volume. This bottle is similar to the squeeze bottles utilized by hair stylists, but has a body of distorted or "sagged" shape so as to render it easier for the tube 54 to pick up the hair treating material contained in the bottle 51. In order to help the tube 54 pick up as much as possible when the bottle is nearly empty, the end of the tube 54 is provided with a sinker 55.

Tube 54 is made of a soft elastomeric material which will collapse if squeezed by moderate pressure applied at opposite sides of the tube. However, the wall of tube 54 is thick enough so that the tube will not collapse by application of any reasonable suction pressure.

Tube 54 extends through handle-pump 42 to washer 54A, which is unitary with the tube 54. Two elastomeric duck-bill valves 56A and 56B are pushed into the bore of the tube 54 and are cemented into place. An end view of one of the duck-bill valves is seen in FIG. 9. The duck-bill valves have a heavy body portion which somewhat expands the tube 54 and a thin-lip portion which performs the valving function. Because of the particular contours of the duck-bill valves, as shown in FIG. 5, the functioning of the thin lip portion is not affected by stresses in or strains of the body portion.

The tube 54 is slipped into pump-handle 42 by being threaded through from the left end of housing 58 until the washer 54A abuts against retainer 59, which secures captive nut 60. Then the elastomeric collar-washer 57 is threaded over the right end of tube 54 until the collar-washer 57 abuts against retainer 61. It will be noted that the elastomeric collar-washer 57 fits tightly on elastomeric tube 54, so that the joint between them is leak-tight. This joint could be cemented, if desired.

Tube 54 is contained within housing 58, as best seen in FIG. 6, and the opening at the bottom of the housing is closed by closure 63. The closure contains a slot which receives an elongated push button 64. When push button 64 is pressed in the direction indicated by arrow 65, the abutting surface 66 collapses the tube 54, as shown by the dotted line 66A in FIG. 6, thereby reducing the volume of the tube 54 between duck-bill valves 56A and 56B. When the push button 64 is released, the resilience of elastomeric tube 54 pushes push button 64 down and the said volume is restored. The alternate reduction and expansion of said volume, in combination with the one-way check valve operation of the two duck-bill valves 56A and 56B, results in a pumping action from right to left.

Closure 63 and retainers 59 and 61 are cemented to housing 58.

The captive nut 62 mates with the screw threads 52 and clamps reservoir section 43 firmly in place in a leak-tight manner against collar-washer 57. The reservoir can be clamped into place in any desired opentation with respect to the handle, since the captive nut 62 will tighten the joint between collar-washer 57 and the mouth of bottle 51 at any desired orientation.

The captive nut 60 mates with screw thread 71 of combhead 41. Since the captive nut 60 can be swiveled in any direction, it follows that the comb-head can be clamped against washer 56 in any orientation. This is advantageous since some hair stylists prefer to press the push button 64 with the balls of their fingers while others prefer to press the push button 64 with the gripping portion of their fingers closer to the palm.

The comb-head 41 includes the spine 70 which supports the teeth 74. Between teeth are gullets 75. The spine 70 has a large main bore 72 and a plurality of small branch bores 73, which lead to selected ones of the gullets 75. As shown in FIG. 5, there is a small branch bore 73 for every third gullet. Thus, using this comb-head, approximately one third of the hair shafts forming the outer surface of a laminar sheaf would be treated. The small bores 73 lead directly to the bottoms of the gullets 75, as seen in FIG. 7, so that only the hair which is wiping past the delivery end of the small bores 73 would receive any hair treating material.

The large main bore 72 is of such size that there is substantially no pressure difference at the entrances of the different small branch bores 73. Furthermore, the small branch bores 73 are of such small size that substantially all of the pressure drop takes place therein, and this pressure drop is high enough to limit the advance of push button 64 as it is squeezed by the hair stylist. As a result, the amount of hair treating material dispensed per unit time at each of the gullets 75 whereat a small branch bore 73 terminates will depend on the pressure exerted on the push button 64 by the hair stylists. With the application of uniform pressure, the push button 64 necessarily moves uniformly. It is much easier for the hair stylist to exert uniform pressure in the disclosed system than it would be to achieve uniform movement of the push button of a similar system having no pressure drop in the small branch bores. Furthermore, the feel of the handle-pump in the disclosed system is better, as the slowly collapsing back resistance of push button 64 furnishes a feed-back signal to the hair stylist.

The inner diameter of tube 54 is determined by the fact that the tube, when fully collapsed between duck-bill valves 56A and 56B, must have expelled enough hair treating material for one full stroke of the coloring comb 35.

The use of a disassembleable joint between the handlepump 42 and the comb-head 42 is necessitated by the requirement that the comb-head be sterilized between uses. It is to be noted that it is impossible for the hair treating material to back up from the comb-head 41 into the handle-pump 42, both because there is no appreciable back pressure at the branch bores 73 and because there are two duck-bill valves 56A and 56B in series in the handle-pump 42. Thus, it is not necessary to sterlize the handle-pump 42 between uses.

It is to be further noted that the complete plumbing of the coloring comb 35 and construction is simple. All parts can be readily flushed out with liquid detergent, water or anticeptic material.

Some of the chemicals used in hair treating material are corrosive to metals and are harmful to the skin. The construction of the coloring comb 35 is such that only chemically resistant polymeric materials and chemically resistant plastic materials are used. The fact that the tube 54 is continuous without a seam through the handle-pump 42 ensures that there will be no leakage of hair treating material.

A series of differing comb heads can be provided to leave deposits on the upper face of a laminar sheaf which are suited to the different styles desired. For example, there could be combs with small branch bores at every second, fourth or fifth gullet. Furthermore, the teeth could be arranged in a pitch either finer or coarser than that shown. Finally, the pattern may be small branch bores at three adjacent gullets, spaced by two ordinary gullets, etc.

Because of the way the herein disclosed coloring comb is used to deposit a series of stripes of hair treating material along the lay of the hair on one face of a laminar sheaf, and because the hair treating material will not run from where it is deposited, it follows that each parting of hair acts as a barrier with respect to an underlying parting. By the time the next overlying parting is laid down, the previously applied treating material will have sunk into and been absorbed by the hair, so that it will not off-set to the overlying parting. In view of this, the use of elaborate separator precautions is not an absolute necessity and can be dispensed with, in many instances.

Furthermore, almost all of the treating material is deposited on the hair and substantially none reaches the scalp. When the coloring comb is adjacent the scalp, the spine of the comb acts as a spacer to keep a separation between the treating material and the scalp. Hence, it is not necessary to use barrier materials to protect the clients scalp.

The herein disclosed coloring comb is useful for an operation known as color retouch. Human hair grows about a centimeter or more a month. Therefore, a month after a client has had a hair coloring treatment in accordance with the instant invention, there will be new hair at the roots which will have the full natural pigmentation. This situation makes it necessary, from time to time, to color the new growth so that uniform color is achieved from the root to the demarcation line on the hair from the previous color treatment. The coloring comb can be used for this retouch process. The hair stylist first isolates the original laminar sheaf of the previous treatment. This is relatively easily done, since it involves merely probing with the rat tail comb to establish the original separation, with the previously treated hair shafts being the guide-post indicators. Next, the hair stylist matches the previously created pattern, such as streaking or frosting, with the particular comb-head which created the pattern. Finally the hair stylist uses that particular comb-head to treat only the grown out portion of the laminar sheaf, carefully inserting the comb-head into the laminar sheaf, adjacent the scalp, so that the small branch bores are in alignment with the previously treated areas.

It will be seen from what has been described above that a great advantage of the invention is that the hair, as a whole, is not obscured while it is being worked on, in distinction with other methods. Thus, the hair stylist is at all times aware of what is happening to the hair, has visual control of the application of the hair treating material, and has a greater freedom to create. The client can also see what is going on, and can furnish some input into the coloring process.

The manipulations involved in the use of the coloring comb 35 are similar to those involved in the use of an ordinary comb, and skill in handling the coloring comb is easy to acquire. A simple rule is followed: The coloring comb 35 combs the laminar sheaf in the same direction as that in which the hair will be styled.

This disclosure is pointed toward use with the human subject. The method and apparatus can also be used on hairpieces of human hair. The chemicals that are used on human subjects are compatable with human hairpieces such as wigs, topees, wiglets, falls, etc. The hairpiece is mounted on a wig form and is manipulated and treated much as if it were hair on a person's head, as will be apparent to those skilled in the art.

The comb-head 41 is preferably made of transparent material, so that it is easier to line up the small branch bores with the particular hair shafts which it is desired to color. If made of opaque material, the spine 70 can be provided with indicia to show at which gullets the hair treating material is delivered. A transparent comb head simplifies flushing out and detection of clogging.

I claim:

1. The method of treating hair which comprises the steps of:

combing the hair to cause the hair shafts to lie in a natural parallel relationship;

defining a hair parting zone, consisting of the length of all the shafts of hair which have their roots within a closed, contiguous area of the person's scalp;

said area having a generally rectangular shape;

subjecting the hair in said parting zone to tension so as to shape said hair into a laminar sheaf between the scalp and the place where tension is applied to the hair;

said laminar sheaf presenting an exterior face formed by adjacent exposed hair shafts, which exterior face is freely accessible to treatment;

applying thixotropic treating material to the exterior face of said hair treatment zone in a plurality of generally parallel spaced treated areas running along the lay of said hair;

said spaced treated areas being separated by untreated areas running along the lay of said hair;

said application of said thixotropic treating material being applied on the whole or parts of the length of the laminar sheath;

moving through the hair from a portion closer to the scalp to a portion more remote from the scalp, the thixotropic treating material being applied in a traverse along the lay of the hair.

2. The method of treating hair in accordance with claim 1 wherein said thixotropic treating material is applied simultaneously to the exterior face of said treatment zone in a plurality of generally parallel spaced treated areas running along the layer of said hair.

3. The method of treating hair which comprises the steps of:

combining the hair to cause the hair shafts to lie in a natural parallel relationship;

defining a hair parting zone, consisting of the length of all the shafts of hair which have their roots within a closed, contiguous and corresponding area of the person's scalp;

said area having a generally rectangular shape;

said hair parting zone being defined by combing away any overlying hair not belonging to said hair parting zone;

subjecting the hair in said hair parting zone to tension so as to shape said hair into a laminar sheaf between the scalp and the place whereat tension is applied to said hair;

said laminar sheaf being unitary and presenting an exterior face formed by adjacent exposed hair shafts, which exterior face is freely accessible to treatment;

simultaneously applying treating material to the exterior face of said hair treatment zone only in a plurality of generally parallel spaced treated areas running along the lay of said hair;

said simultaneous application of said treating material initially and simultaneously being made to the exterior face of said hair treatment zone at the portion thereof closer to the scalp and finally and simultaneously being made to the portion thereof more remote from the scalp;

said simultaneous application of said treating material being made continuously during successively spaced intervals of time between the time of said simultaneous application initially and the time of said simultaneous application finally;

while the locus of said simultaneous application continuously and correspondingly moves from said portion thereof closer to the scalp to said portion thereof more remote from the scalp;

said simultaneously application of said treating material being made in a single transverse along the lay of said exterior face of said hair parting zone;

said simultaneous application of said treating material, under manual control, being made uniformly in said treated areas along and athwart the length of said single traverse; and similarly and sequentially applying hair treating material to other hair parting zones, selected for treatment, until all selected hair parting zones have been treated.

4. The method of claim 3 in which said application of the treating material to the exterior face of the laminar sheaf extends from substantially the roots to the tips of the hair shafts.

5. The method of claim 3 in which said application of the treating material to the exterior face of the laminar sheaf extends from a region between the roots and the tips of the hair shafts substantially to the tips of said hair shafts.

6. The method of retouching the roots of hair which have been previously treated by the method of claim 3, and in which the roots have grown out, which comprises the steps of combing the hair to cause the strands to lie in a natural overlapping parallel relationship;

identifying the hair of said hair parting zone of claim 3 by its appearance;

combing away from said identified hair parting zone and overlying hair not belonging to said identified hair parting zone;

subjecting the hair in said hair parting zone to tension so as to shape said hair into a laminar sheaf between the scalp and the place whereat tension is applied to the hair;

said laminar sheaf being unitary and presenting an exterior face formed by adjacent exposed hair shafts, which exterior face is freely accessible to treatment; touching up selected roots of the hair of said hair parting zone by applying treating material to the untreated portion of the exterior face of said laminar sheaf, which are in alignment with the treated areas left from the prior treatment.

7. The method of claim 3 in which the plurality of hair parting zones includes a portion only of the person's hair.

8. The method of claim 3 in which the plurality of hair parting zones includes substantially all of a person'-hair.

9. The method of claim 3 in which the plurality of hair parting zones is treated, seriatim, beginning at the nape and progressing towards the crown.

10. The method of claim 3 in which the plurality of hair parting zones is treated, seriatim, beginning at one zone and progressing to other zones, sidewise around the head.

11. The method of claim 3 in which said hair parting zone is further defined by isolating said hair parting zone with barrier material from any underlying skin and from any underlying hair not belonging to said hair parting zone.

12. The method of claim 3 which includes further defining each hair parting zone by separating at least one of said hair parting zones from the underlying hair not belonging to said one hair parting zone by establishing a barrier, impenetrable to said treating material, immediately beneath the hair of said hair parting zone and immediately above the underlying hair not belonging to said hair parting zone.

13. The method of treating hair which comprises the steps of:

combing the hair to cause the hair shafts to lie in a natural parallel relationship;

defining a hair parting zone, consisting of the length of all the shafts of hair which have their roots within a closed, contiguous area of the person's scalp;

subjecting the hair in said parting zone to tension so as to shape said hair into a laminar sheaf between the scalp and the place where tension is applied to the hair;

said laminar sheaf presenting an exterior face formed by adjacent exposed hair shafts, which exterior face is freely accessible to treatment;

applying thixotropic treating material to the exterior face of said hair treatment zone in a plurality of generally parallel spaced treated areas running along the lay of said hair;

said spaced treated areas being separated by untreated areas running along the lay of said hair;

said application of said thixotropic treating material being applied on the whole or parts of the length of the laminar sheath;

moving through the hair from a portion closer to the scalp to a portion more remote from the scalp, the thixotropic treating material being applied in a traverse along the lay of the hair.

* * * * *